US005960992A

United States Patent [19]

Bernstein et al.

[11] Patent Number: 5,960,992

[45] Date of Patent: Oct. 5, 1999

[54] ASEPTIC BRICK PACKAGE SPOUT

[75] Inventors: Linda A. Bernstein, Maineville, Ohio; Robert L. Gordon, Monroe, N.Y.

[73] Assignee: International Paper Company, Purchase, N.Y.

[21] Appl. No.: 08/868,818

[22] Filed: Jul. 30, 1997

Related U.S. Application Data

[63] Continuation-in-part of application No. 08/538,674, Oct. 3, 1995, abandoned.

[51] Int. Cl.[6] ..... B67D 5/00

[52] U.S. Cl. ..... 222/83.5; 222/88; 222/91; 222/541.2

[58] Field of Search ..... 222/81, 83, 83.5, 222/88, 89, 91, 541.2

[56] References Cited

U.S. PATENT DOCUMENTS

| | | | |
|---|---|---|---|
| 5,141,133 | 8/1992 | Ninomiya et al. | 222/83 |
| 5,147,070 | 9/1992 | Iwamoto | 222/83 |
| 5,297,696 | 3/1994 | Bernstein et al. | 222/83 |
| 5,366,114 | 11/1994 | Bernstein et al. | 222/83 |
| 5,405,053 | 4/1995 | Zublin | 222/83.5 |
| 5,482,176 | 1/1996 | Maietta et al. | 222/83 |

*Primary Examiner*—Joseph A. Kaufman
*Attorney, Agent, or Firm*—Michael J. Doyle

[57] ABSTRACT

A brick type container, particularly adapted for aseptic packaging of product such as potable liquids, is formed having optimum dimensions and location of a pour spout fitment thereon. The dimensions of the pour spout components are chosen for optimum performance. The top of the container carries a dispensing opening covered by a severable or frangible extrusion coating or other type of membrane. The fitment is applied to the container by applying it while the container is encased in a pocket on a conveyor, the pocket sides being rigid. The fitment includes a hollow cutter having cutting teeth on its lower periphery, the cutter also functioning as part of a pour spout. The toothed end of the cutter severs the membrane to permit dispensing of product from the carton. To prevent the severed extrusion or membrane which originally covers the dispensing opening from passing out of the carton upon dispensing of product, a flow filter is provided in the form of bars at one end of the entrance lumen of the cutter element. Typically, these bars are integrally molded with the cutter. The bars are located above the lower portions of the cutting teeth, in a plane containing the teeth roots or bases, to thereby preclude entry of a severed disc of membrane from entering the lumen of the pour spout or the cutter.

4 Claims, 6 Drawing Sheets

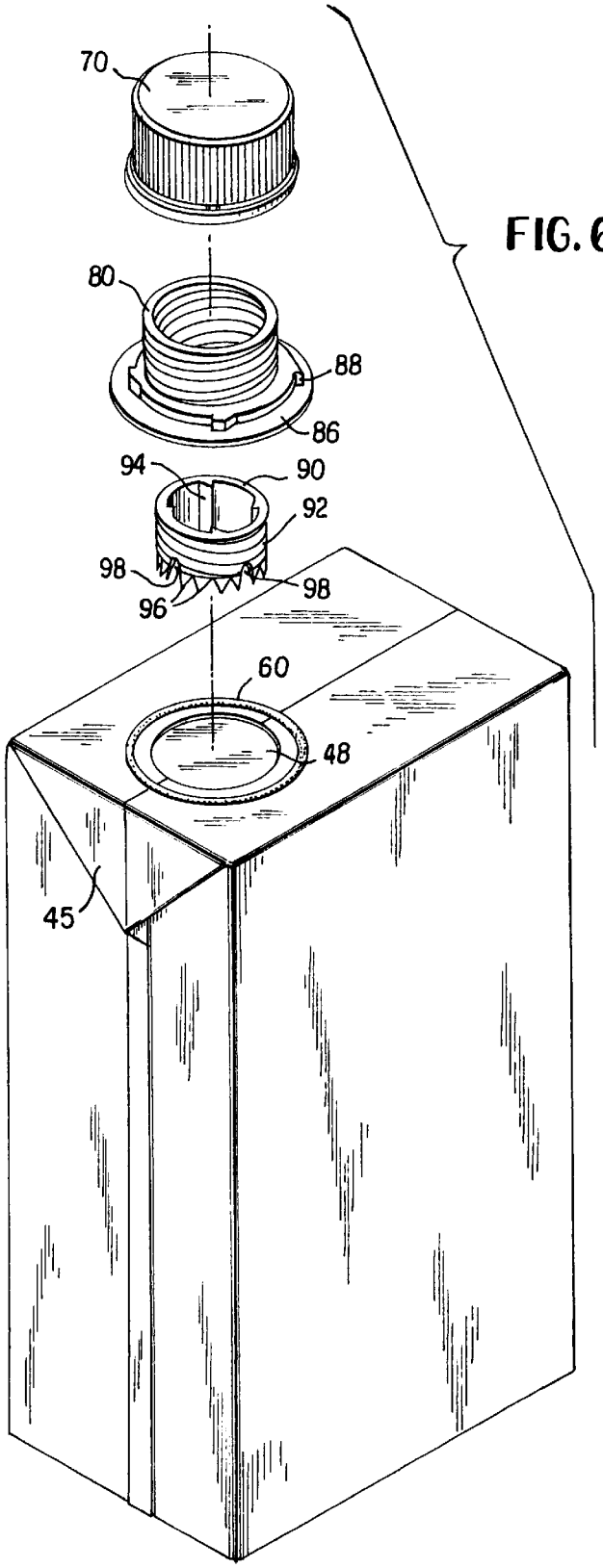
FIG. 6
FIG. 7
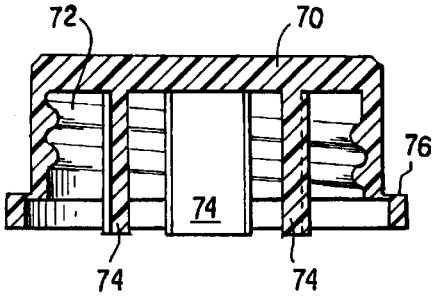
FIG. 8
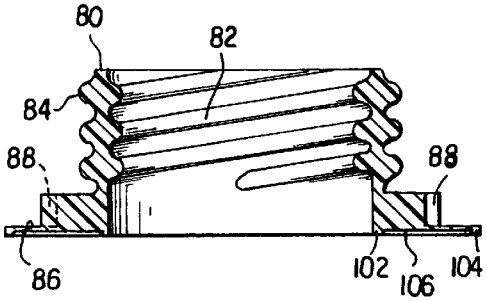
FIG. 9
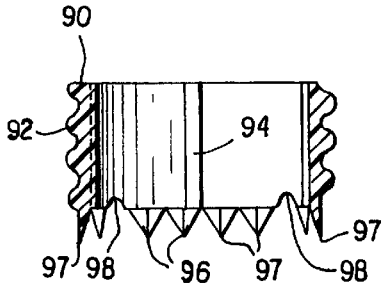

ASEPTIC BRICK PACKAGE SPOUT

BACKGROUND OF THE INVENTION

This is a Continuation In Part application of U.S. patent application Ser. No. 08/538,674, now abandoned filed Oct. 3, 1995 by Linda A. Bernstein and Robert L. Gordon and entitled Aseptic Brick Package Spout.

This invention relates to containers and more particularly to brick-type containers fashioned from paperboard and particularly adapted for aseptic packaging of liquids and other foodstuffs. Brick-type containers are in the general form of a rectangular parallelepiped, and take their name from their resemblance in shape to a common masonry brick. Typically, one end of the package is provided with a plastic fitment, the fitment including a screw cap and a pouring nozzle. The material from which the container is fashioned is typically paperboard coated on one or both of its surfaces with one or more layers of various known barrier materials such as polymeric barrier materials.

Examples of this general type of container and fitment pouring spout are seen in U.S. Pat. Nos. 4,948,015 and 5,027,979 issued to Kawajiri et al and 4,483,464 issued to Nomura. Such containers have typically been used in the packaging of potable liquids, such as milk and fruit juice. Brick style packages are the packages of choice but it is obvious that the spout and container construction can be used on other package shapes, such as gable top containers.

SUMMARY OF THE INVENTION

According to the practice of this invention, optimum dimensions and proportions of a pour fitment and an aseptic brick package are employed. The specific adhesives employed, the area of adhesive coverage needed to prevent leakage, the amount of adhesive, and the specific location of the fitment on the package, as well as the extrusion over void area over the pour spout dispensing opening are employed for optimum results. Typically, in carrying out this invention, the pour spout fitments are located above the incoming filled aseptic brick packages, the packages being filled with milk or fruit juice. A hot melt adhesive bead or ring is applied around the perimeter of a dispensing opening which is spanned and closed by one or more barrier layers coating the paperboard. The fitment, provided with a lower flange and of molded plastic, is placed on top of the hot melt adhesive and pressure is applied. Next, the filled brick containers are conveyed, over a period of three to five seconds, with pressure maintained on the fitment flange area, to set the hot melt adhesive. Lastly, the completed packages are conveyed to a pallet area for loading and packaging.

In order to provide a firm or rigid base for placing the fitment onto the top of the container, pairs of liquid filled containers with their sides bulging somewhat from the weight of liquid therein, are placed into pockets or nests in a carousel. The side walls of the pockets are fitted with bladders on each inner side wall. The bladders are inflated by cam action using pneumatic valves. This squeezes the sides of the brick package forcing the liquid level upward, causing the top surfaces of the brick packages to become firm. In this way, when a fitment flange is placed above the adhesive ring and pushed down, the container top will not bend downwardly due to the incompressibility of the liquid, and a firm adhesive bond will result.

BRIEF DESCRIPTION OF THE DRAWINGS

FIG. 6 is a view of a filled carton, the carton provided with a three component plastic pour and rupture fitment shown as exploded.

FIGS. 7, 8, and 9 are respective transverse cross sectional views of the three parts of the fitment of FIG. 6.

DETAILED DESCRIPTION OF THE INVENTION

Figure 1:
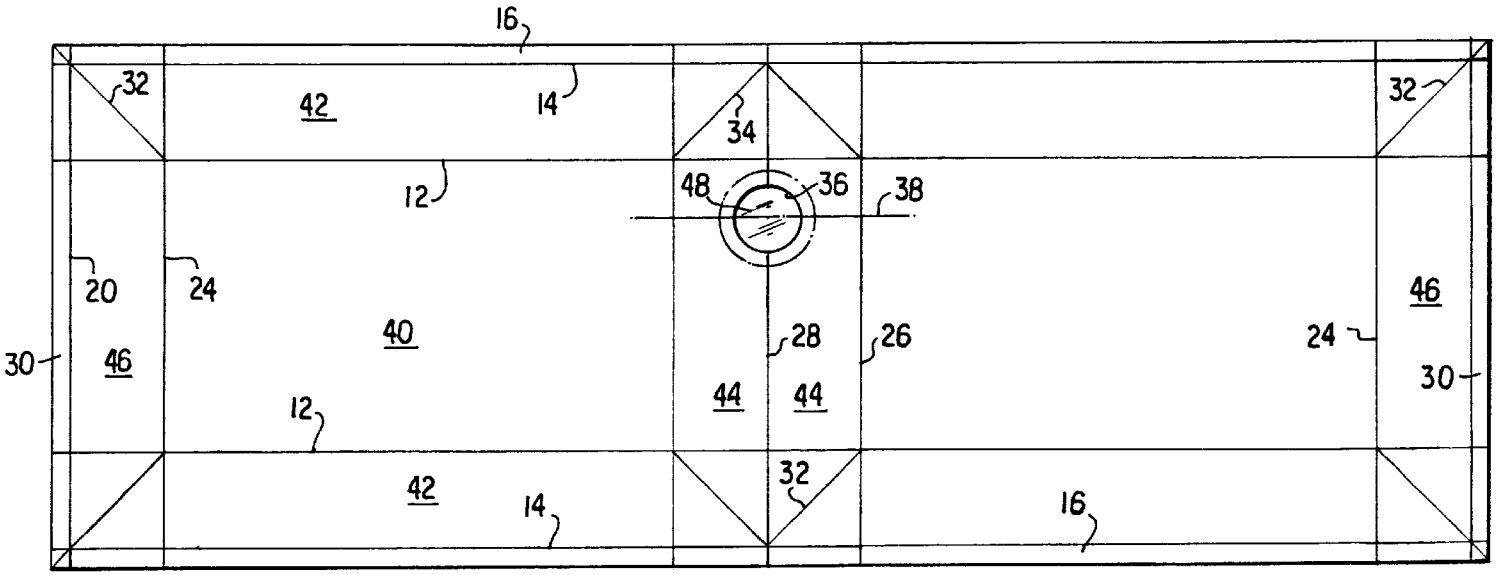
FIG. 1 is a plan view of a unitary paperboard blank from which the carton of this invention is formed.
Figure 10:
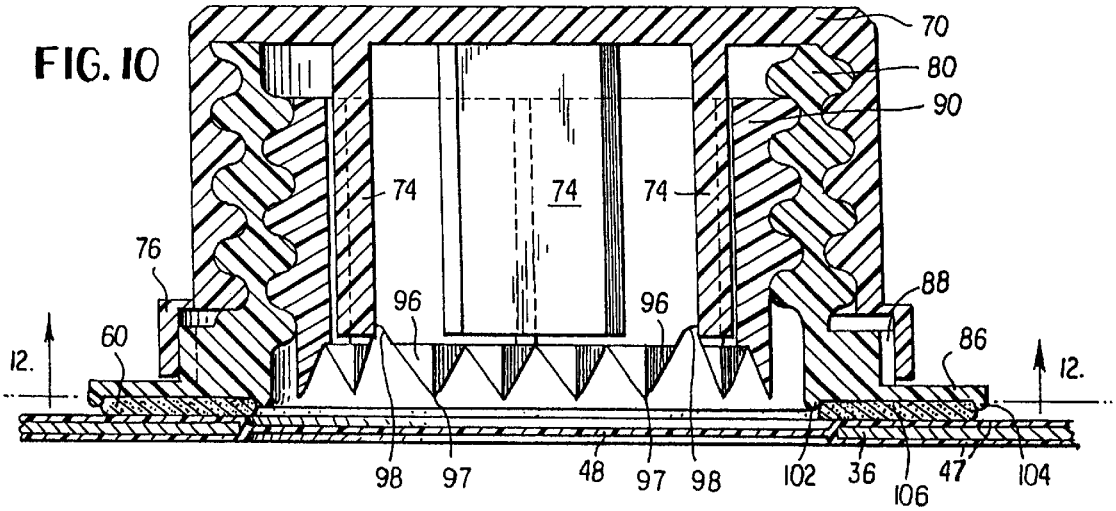
FIGS. 10 and 11 are transverse sections illustrating the seal piercing action of the fitment.
Figure 11:
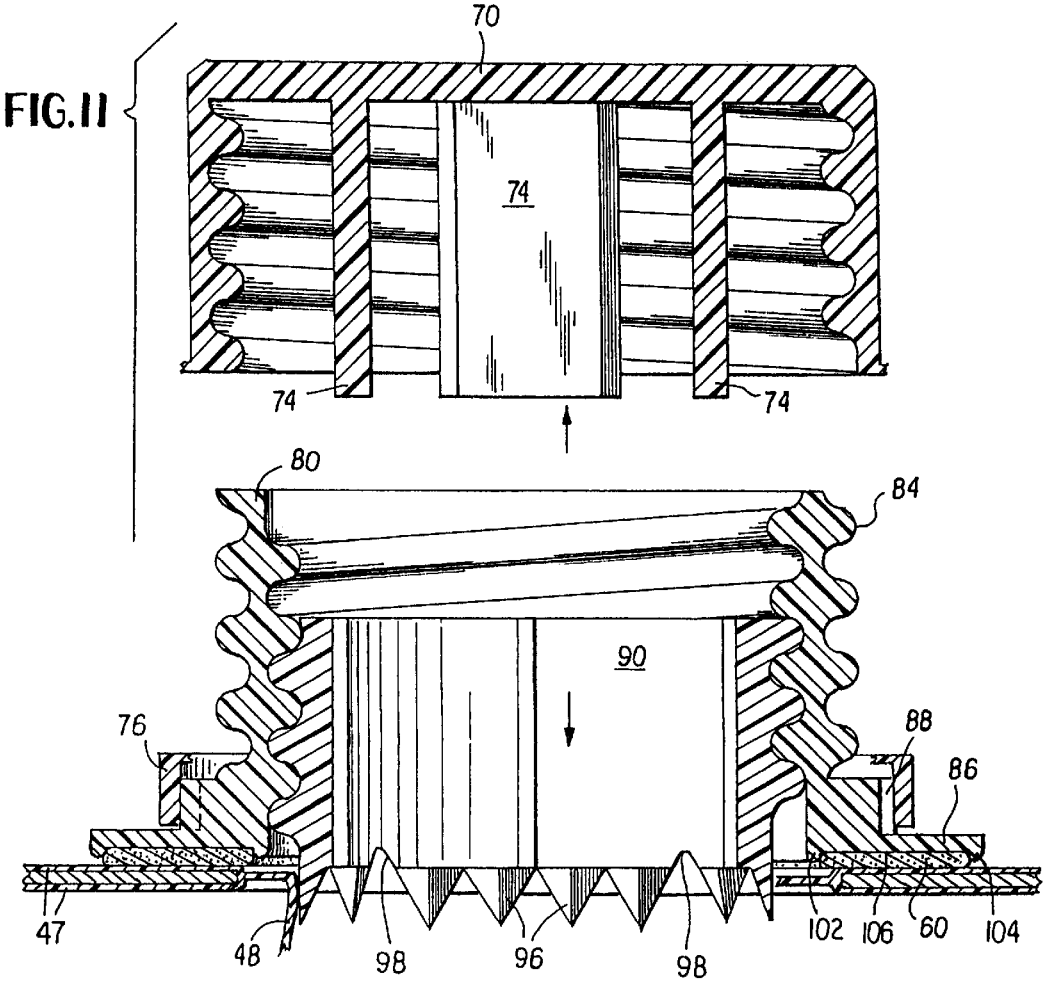

Referring now to FIG. 1 of the drawings, a unitary blank of paperboard or other stiff, foldable and resilient material is designated as 10. The blank is rectangular with its central longitudinal axis horizontal and its central transverse axis vertical and has two horizontal score lines 12. Vertically extending fold lines 20, 24, 26 and 28 extend from the top to the bottom edges of the blank, with the distance between the left and right blank edges and respective score lines 20 defining left and right borders or strips 30. Forty-five degree score lines 32 extend from the four corners, respectively, to the intersection of score lines 24 and 12. Forty-five degree score lines are also located, as indicated, at the middle of the blank and extend from respective points on respective score lines 14 to the intersections, respectively, with score lines 26 and 12. Dispensing aperture 36 is cut through the blank, with its center being below the top edge of the blank on imaginary axis 38 which intersects score line 28. Polymeric extrusion barrier layers 47 (known in this art) cover both surfaces of the blank, as shown at FIG. 10 and 11, and are squeezed together to form a layer 48 which spans opening 36.

The above described score lines define panels 40, 42, and 46, with panels 40 defining the front and rear walls of the carton and panels 42, when folded together with their edges, define side walls of the carton. The top of the carton is defined by panels 44, while the bottom of the carton is defined by panels 46.

The length of blank 10 is about 18.58 inches (472 mm) and its width is about 6.70 inches (170.2 mm).

Figure 2:
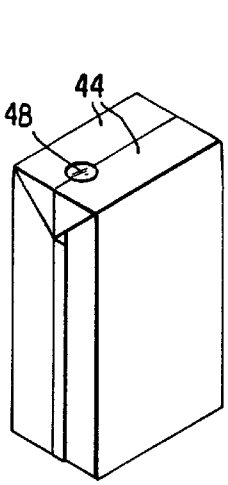
FIG. 2 is a perspective view of a formed, filled and sealed aseptic container according to the practice of this invention.

The blank of FIG. 1 is folded and glued and filled with a liquid in a manner known in this art to form a brick type package shown at FIG. 2. Triangular flaps 45 extend from the top of the carton and down onto the sidewalls and overlap side seams defined by sealing together zones 16. Flaps similar to 45 are formed at the bottom of the carton, with flaps 45 defined from the upper and lower ends of panels 44, with the (not illustrated) corresponding triangular flaps of the bottom defined by the upper and lower edges of panels 46. The general shape and the manner of formation of the carton shown at FIG. 2 is known in this art. The height of the carton or container is about 6.57 inches (167 mm) and its thickness is about 2.44 inches (62 mm) and its width is about 3.70 inches (94.2 mm).

Figure 3:
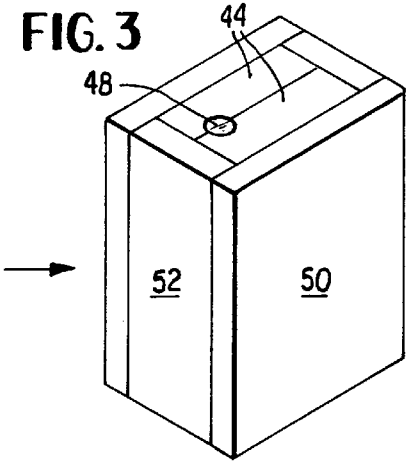
FIG. 3 is a view illustrating the container of FIG. 2 after it has been placed in a pocket of a pocketed conveyor.

Referring now to FIG. 3, the cartons of FIG. 2 have been placed in a pocket or nest on a conveyor, the pocket defined by upstanding sidewalls 50. It will be understood that an endless conveyor of any conventional construction carries a plurality of such pockets and it only be necessary to illustrate one pocket for an understanding of this invention. After the filled and sealed container is placed in the pocket shown at FIG. 3, the sidewalls of the container still bulge. When the bladders in the nests are activated, the level of the liquid in the container is forced upward so that there is practically no void or space between the bottom surface of the top of the container and the top of the liquid in it.

Figure 4:
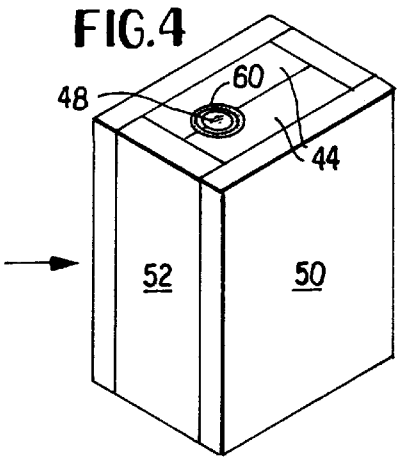
FIG. 4 is a view similar to FIG. 3 and illustrates the aseptic container after it has been provided with a continuous bead of a hot melt adhesive around its upper dispensing opening.

FIG. 4 is similar to FIG. 3 except for a ring or band of adhesive 60 having been placed around dispensing opening 36. The dimensions of this ring of adhesive are critical, as is the location of dispensing opening 36 relative to the top of the container. The bead 60 is 0.125 inches (3.2 mm) wide.

Figure 5:
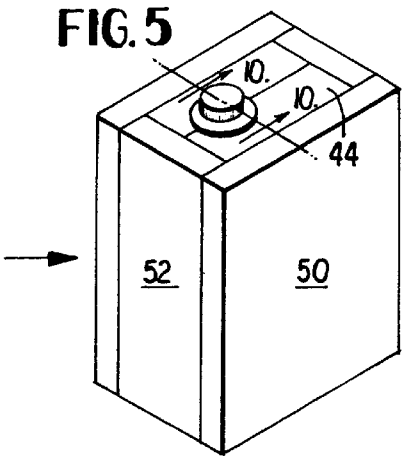
FIG. 5 is a view similar to FIG. 4 and illustrates the placement of the fitment on the aseptic container while the container is still in a pocket of a pocketed conveyor.

Referring now to FIG. 5, a flanged plastic pour spout fitment has been placed on top of the container. This is illustrated at FIG. 5 wherein the flange of the plastic pour spout fitment (shortly to be described) has been placed onto adhesive ring 60 and squeezed downwardly. Such downward motion would ordinarily cause a flexing or bending down of the top of the container. Such flexing would result in an improper adhesive connection between the plastic fitment and the container. By virtue of being in a pocket, the outward bulges of the container no longer exist and the top of the liquid is forced against the bottom of the top closure, as explained above. The top of the liquid thus provides a firm backing when the plastic fitment is pushed down upon and secured to the container. If the liquid has a head space above it, instead of the liquid contacting the top, then the increased air pressure will provide a firm backing. Analogously, if gable top type liquid packages are used, instead of brick type packages, the same back pressure action would occur to inhibit deformation of the fitment accepting panel. The flange of the fitment is 0.125 inches (3.2 mm) from the nearest edge of the container, while the diameter of the flange is 1.625 inches (41.3 mm).

Referring now to FIG. 6, the filled container with adhesive ring or bead 60 around its dispensing opening, the latter closed by the above described barrier layer material, is shown in relation to the plastic fitment, the latter shown exploded. This provides exactly the right amount of adhesive to fill the dam between the rings 102 and 104 on the bottom of the spout flange when pressure is applied in the fitment application process.

The fitment is shown in detail at FIGS. 7, 8, and 9 and includes an outer screw cap 70, an intermediate flanged spout member 80, and a piercing element 90, the latter adapted to the frangible barrier layer material 48 spanning the dispensing opening at the time of initial dispensing of the contents.

FIG. 7 illustrates outermost plastic cap 70 which includes a plurality of internal threads 72, four downwardly extending arms 74, and a tamper evident band.

FIG. 8 shows the intermediate fitment spout member 80 having a plurality of inner threads 82 and outer threads 84, the latter terminating in a base flange 86. The outside diameter of flange 86 is 1.625 inches (41.3 mm) and was determined to be optimum in terms of: (a) providing enough surface area for bonding to the package; and, (b) being small enough to allow placement of the pour hole opening as close as possible to the pouring edge of the carton. The closer the pour hole is to the carton edge, the easier it is to pour without spill. The flange of the fitment is 0.125 inches (3.2 mm) from the score line that forms the pouring edge of the carton. The thickness of flange 86 is 0.02 inches (0.5 mm), not including the height of glue dams 102 and 104. Abutments 88, shown also at FIG. 6, are positioned at 90 degree intervals around the upper portion of flange 86.

FIG. 9 shows cutting element 90 having a plurality of external threads 92, four vertically extending ribs 94 and lower circumferential cutting teeth 96, the latter terminating in tips 97. Teeth 96 are interrupted by annularly spaced inverted V shaped drain grooves 98. Grooves 98 provide improved liquid evacuation from the package. The height of cutting teeth is 0.125 inches (3.2 mm). This tooth height has been determined to be critical in yielding a clean cut on extrusion layer 48, as opposed to a ragged opening. The spout of the fitment was designed especially for adhesion to the aseptic package. The flange 86 is 0.020 inches (0.5 mm) thick, not including glue dams 102 and 104. Also, the spout is made of polyethylene. These two features allow the flange to flex with the package, reducing the danger of the spout detaching from the package during handling and distribution. The thicker and less flexible spout wall does not flex and aids in protecting the extrusion from the teeth of the insert.

FIG. 10, taken along section 10—10 of FIG. 5, shows the pour spout plastic fitment adhered to and mounted on a filled container. The liquid within the container is not illustrated. Flange 86 of the fitment is in adhesive contact with the top of adhesive bead 60, the latter passing from a round cross section to a generally flat cross section upon downward squeezing by the fitment, with the adhesive joining the fitment to the container. Both outer and inner (upper and lower) extrusion barrier layer coatings 47 are shown, and their fusion, in this art, has produced layer 48 which spans dispensing opening 36. FIG. 10 is the configuration of the fitment prior to initial opening of the fitment and container for dispensing. It will be noted that tips 97 of teeth 96 are above the lowermost surface of beads 102 and 104 of flange 86. It has been found that this difference in height, for optimum results, is 0.0625 inches (1.59 mm). This distance is built in to protect extrusion 48 during package distribution by preventing contact of teeth tips 97 with extrusion 48. This difference in height further permits the assembled fitments of FIG. 10 to be conveyed on a flat surface to an assembly station without injury of breakage of tips 97.

Turning now to FIG. 11, fitment cap 70 has been rotated so as to unscrew it from threads 84, causing the cap to move upwardly. Because of the interaction between posts 74 on vertically extending ribs 94 (see FIG. 9) cutting member 90 is simultaneously rotated in the same direction, but, because of the pitch of the threads 92 and 82, the cutting member 90 moves downwardly to rotate and cut the peripheral portions of extrusion layer 48 as it rotates. For convenience in illustration, FIG. 11 shows the top cap completely off of the fitment, with the contents of the container now being ready for dispensing. After the initial dispensing, cap 70 is screwed down upon the fitment until the next dispensing operation.

Figure 12:
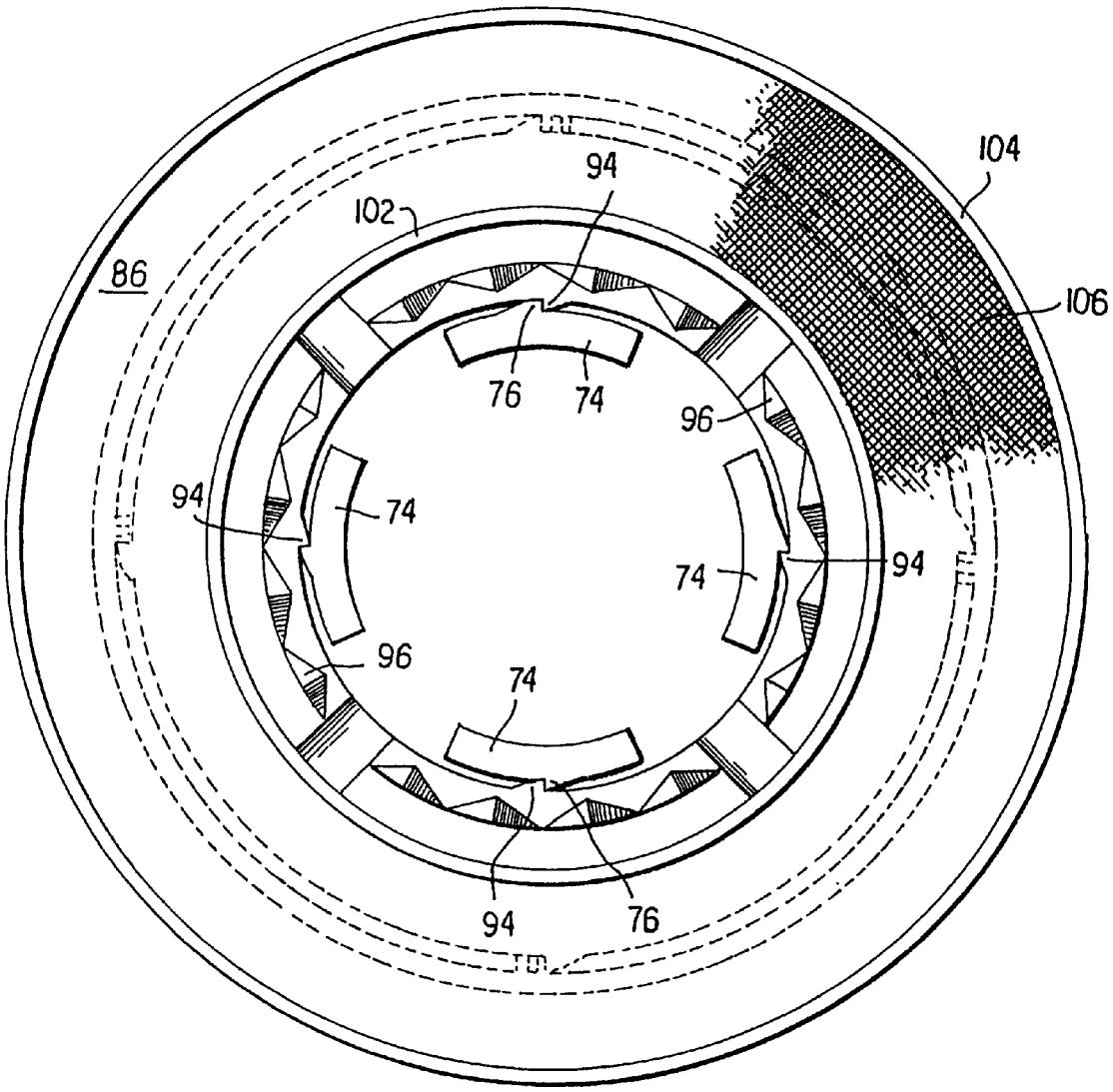
FIG. 12 is a view taken substantially along section 12—12 of FIG. 10.

FIG. 12 is a view taken along section 12—12 of FIG. 10 and illustrates the relation between the several elements of the plastic fitment to yield the above described action. Inner and outer integral molded beads 102 and 104, respectively, border the inner and outer peripheries of the bottom surface of flange 86. Both are of a height of 0.01 inches (0.25 mm). The continuous annular space between these beads is denoted as 106 and is textured. For convenience in illustration, only a limited annular portion of the flange bottom is shown as textured, it being understood that the texture runs completely around the flange. The texture is defined by intersecting molded grooves. Beads 102 and 104 serve as dams to contain hot melt adhesive 60 and prevent the hot melt from oozing out from under flange 86 during application of the fitment flange to the package.

The dimensions of the blank and of the fitment parameters set out above are for a one liter container.

Figure 13:
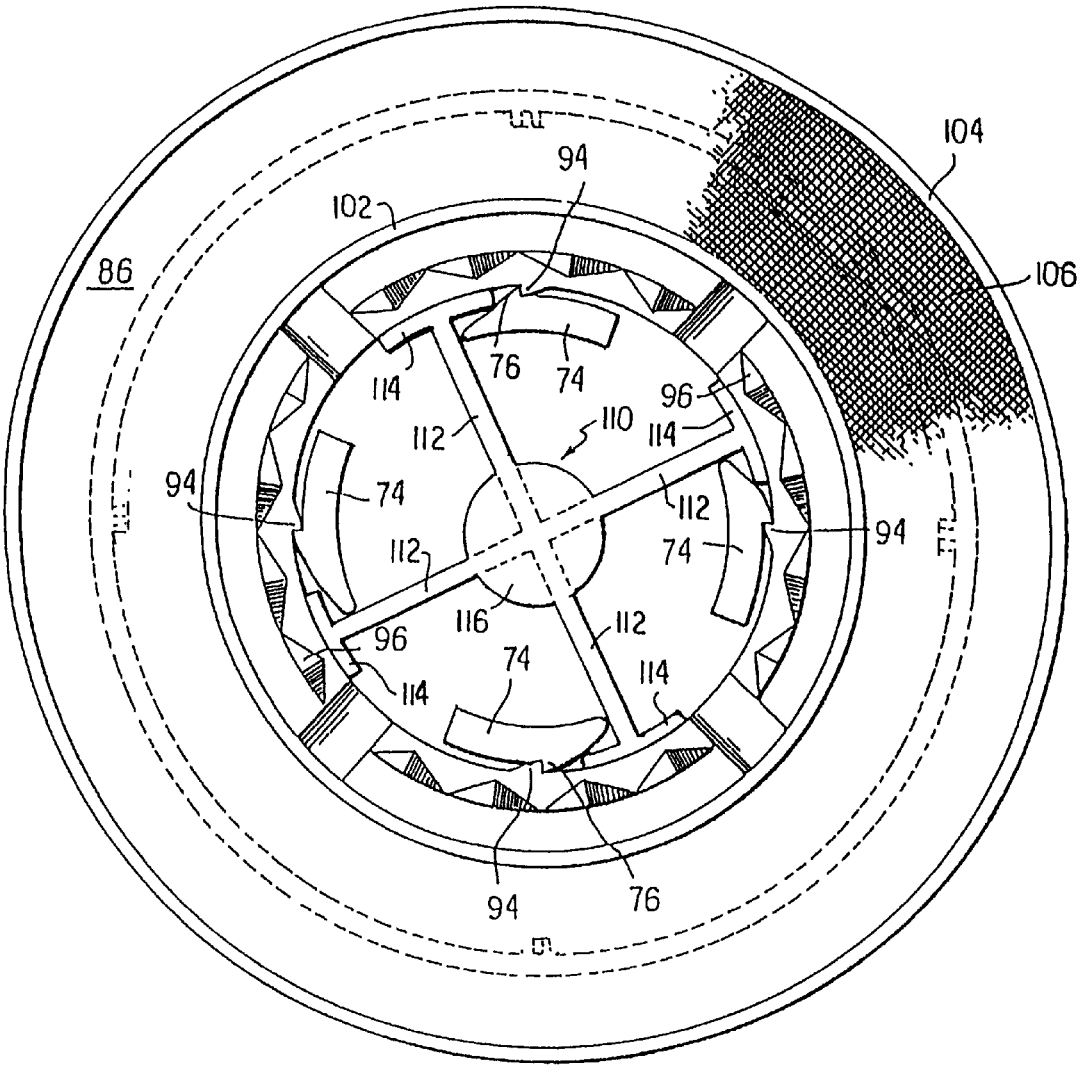
FIG. 13 is a view similar to FIG. 12 and illustrates the addition of a cross element molded into the lower portion of cutting element 90 shown at FIG. 9.
Figure 14:
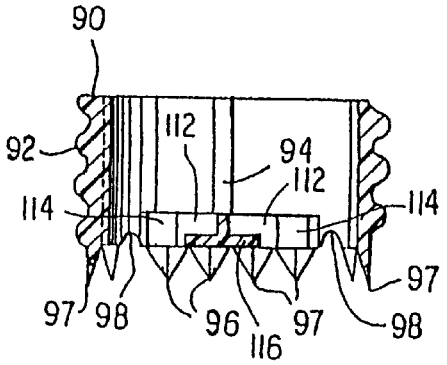
FIG. 14 is a view similar to FIG. 9 and shows a cross element molded into the lower portion of cutting element 90 of the latter.

Referring now to FIGS. 13 and 14, a modification is illustrated wherein the lumen or pour opening of cutting element 90 is provided with a flow filtering member 110 including a pair of crossed and diametrically extending bars 112, typically rectangular in transverse cross section. The outer ends of bars 112 carry enlargements 114. A disc 116 may be included at the intersection of bars 112 for enhanced strength and rigidity. The disc may be above or below the intersection of bars 112, or it may assume the form of coplanar reinforcements between pairs of intersecting bars. The material of construction of member 110 is preferably the same as that of cutter 90, since they are concurrently formed in the same molding operation. While preferably lying in a single horizontal plane as shown at FIG. 14, the intersecting central portions of the bars may be lower or higher than enlargements 114.

As shown at FIG. 11, cutting teeth 96 cut extrusion 48 to permit liquid dispensing through the flow areas defined by the spaces between bars 112. Each tooth 96 includes a base attached to the lower periphery of cutter 90. If a segment of the generally circular cut portion of extrusion or membrane 48 remains with the uncut portion after initial cutting, as shown at the left of FIG. 11, then the cut portion will not be dispensed with the liquid. If however the cut portion falls into the liquid in the container, the former may pass out of the spout during pouring, as into a drinking glass, and be accidentally consumed. To preclude such an undesired event, bars 112 of flow filter 110 will intercept the cut portion and thus prevent the cut portion from entering the pour spout of cutter 90. If the cut portion clogs the spout by being caught by bars 112, the user may shake the container to dislodge it and thus permit repouring. It will be apparent that the number and angular orientation of bars 112 may be varied. Three is optimal. The plane of bars 112 is shown as orthogonal to the lumen of the cutter 90.

After the cutting teeth on cutter 90 cut away the membrane seal 48, the cross members or bars 112 prevent the cut membrane disc from moving up inside the spout and clogging the pour opening or lumen. The crossed bars 112 allow the liquid inside the container to dislodge the cut out membrane disc, since the disc cannot move upwardly (see FIG. 11) past the crossed bars and inside the spout or lumen of cutter 90. The moving liquid being poured will in a sense wash away the cut membrane disc from the cutting teeth area, thus preventing the membrane from passing to the inside of the pour lumen of cutter 90. The crossed bars 112 define a first plane which is substantially coincident with a second plane, the latter plane defined by the bases of cutting teeth 96. The first plane is thus just above the lower or non-base portions of the cutting teeth. By this substantial coincidence of the plane defined by the bases of the cutting teeth 96 with the plane defined by crossed bars 112, the severed membrane cannot find its way into the interior of the pour lumen of toothed cutter 90.

The present construction is thus markedly different, in this respect, from that shown in U.S. Pat. No. 5,297,696 issued to Bernstein et al. In the '696 Bernstein construction a plurality of crossed bars 50 are located at the top or dispensing exit end of a hollow toothed cutter 44 (see Bernstein FIG. 5) having teeth 54. If a severed membrane (72 of Bernstein) were to enter the interior of hollow cutter 44, it might be difficult or impossible to dislodge, and thus interfere with the dispensing of product from the carton, even if crossed bars 50 prevented the severed membrane from exiting the pour spout.

It is thus seen that the filtering element defined by crossed bars 112 of FIGS. 13 and 14, and their relation to the cutting teeth, displays utility in connection with various types of pour spouts for membrane sealed brick type packages.

Figure 15:
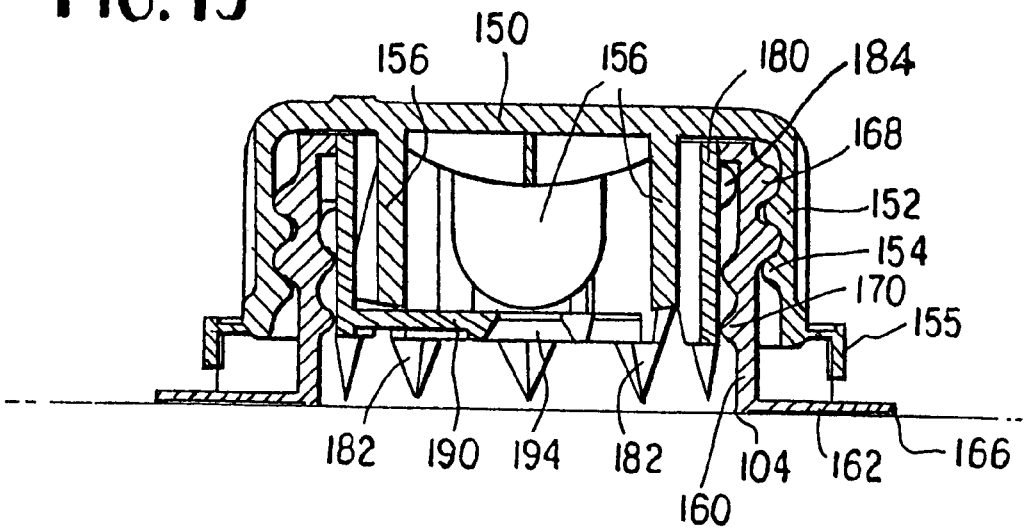
FIG. 15 is a transverse cross-sectional view of a complete fitment according to yet another modification of the invention.

Turning now to FIG. 15 of the drawings, another embodiment of the fitment of this invention is illustrated. This view is similar to FIG. 10, except that the paperboard top wall of the container is not shown, the fitment of FIG. 15 being placed on the top of a paperboard carton in a like manner. Again, a barrier layer (see 48 of FIG. 10) spans and initially closes the pour opening in the container. Also, adhesive similar to adhesive 106 of FIG. 10 is employed to attach the radially outwardly extending flange 162 of fitment to the container top wall also in a like manner. The outer cap includes a central disc portion 150, with the periphery of the disc terminating in an annularly continuous and downwardly extending skirt 152 having internal threads 154. The lowermost portion of the downwardly depending skirt 152 is provided with a tamper evident ring 155 of continuous annular extent frangibly and detachably secured to the lower portion of the cap. Ring 155 is similar to ring 44 of U.S. Pat. No. 5,482,176 issued to Maietta et al, incorporated by reference, and functions in the fitment assembly in a similar manner.

A pour fitment 160 is provided with a lower radially outwardly extending flange 162 whose lower radially innermost and radially outermost portions are each provided with downwardly extending dam portions 166 and 104. These correspond to dam elements 102 and 104 of the embodiment of FIG. 10. Fitment 160 is provided with external threads 168 and internal threads 170. External threads 168 cooperate with internal threads 154 of the outer cap. Disc portion 150 of the cap is provided with four downwardly extending torque or turning arms 156, similar to arms 74 of FIG. 10.

Figure 16:
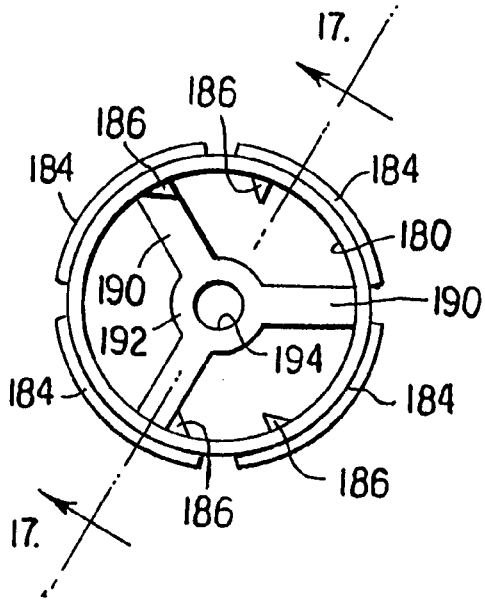
FIG. 16 is a top plan view of the cutter element of FIG. 15.
Figure 17:
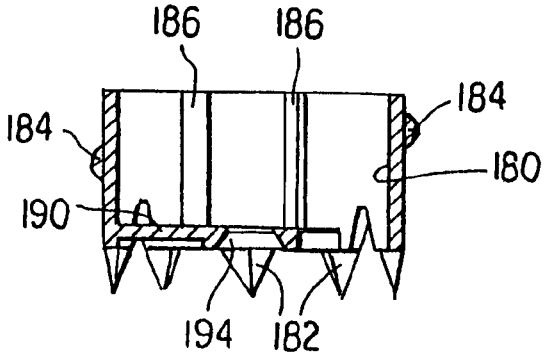
FIG. 17 is a view taken along section 17—17 of FIG. 16.

Two the cap vertical arms 156 fit into complimentary slots defined by slot defining pairs of internal ribs 186 of cutter 180, these ribs shown at FIGS. 16 and 17. If desired, additional pairs of such ribs may be provided for the remaining two vertical arms, or alternatively, only two arms 156 may be used.

The lower portion of circular cutter 180 is provided with a plurality of integral teeth 182, similar to cutting teeth 96 of the embodiment of FIG. 10. Three radially inwardly projecting and angularly spaced bars 190 extend from the lower portion of cutter 180 towards the center of the cutter and terminate in central annular ring 192 having a central opening 194.

Referring now to FIGS. 16 and 17, radially extending bars 190 are seen as spaced 120 degrees from each other with their innermost ends terminating in annular ring 192 having the noted central opening 194. As shown at FIGS. 15, 16 and 17 bars 190 are located in a plane substantially coextensive with a plane defined by the bases of cutting teeth 182, and function as a filter.

In operation, when the paperboard container (see FIG. 6) of fruit juice or other product is initially opened, the outer cap is unscrewed to thereby break tamper evident ring 155 from the cap. Continued unscrewing causes the cap to rise off of pour spout 160 and, concurrently, rotation of the cap and its arms 156 causes the cutter and its teeth 182 to move downwardly as they rotate in an opposite direction from the cap. This causes rupture of membrane 48 covering the pour opening. At its lowermost extent of travel, teeth 182 have cut through the barrier 48 which originally spanned the pour opening at the top of the container. At this point, the now cut barrier material is more or less free and during pouring out of product might find its way in the product flow path and hence into the interior of the pour spout and/or the interior of hollow annular cutter 180. This occurrence would be undesirable since the consumer obviously does not want to have a piece of the membrane (foil and/or plastic) poured into a cup or glass from which the product will be consumed. To preclude such a circumstance or occurrence, radially extending bars 190 and ring 192 and the opening 194 all cooperate, in the manner of a filter, to minimize the likelihood of such an occurrence by keeping the cut membrane on the carton interior or product side of bars 190. By the location of bars 190 and ring 192 at the base of cutting teeth 182, it is not possible for a piece of cut-off sealing membrane 48 to lodge in the interior of cutter 180 or pour spout 160. Bars 190 and ring 192 define a plane which is coincident with a plane containing the bases of teeth 182. Namely, the bases of teeth 182 are in the same plane as bars 190 and ring 192. Bars 190 cannot be placed below the roots or bases of teeth 182, since such placement would interfere with the cutting action through membrane 48.

The construction of this last embodiment is similar in overall construction and operation to the fitment and container construction of the noted Maietta patent. While several details of construction are different (such as the specific manner in which the hollow cutter is rotated by the cap), the most important difference is the presence of the filter bars 190 of this invention, being located in the same plane as a plane containing the roots or bases of teeth 182. Since downwardly depending cap arms or posts 50 of Maietta extend below the plane of the bases of his teeth 39, the addition of radially extending filter bars, such as bars 190 of this invention, in the plane of the bases of the teeth, would only be possible in Maietta with a proper alignment of downwardly depending cap arms relative to the spaces between the radially extending bars. This requirement would introduce manufacturing or assembly problems or both.

This last described embodiment is similar to that of FIGS. 13 and 14 vis-a vis the crossed filter bars at the bottom region of the hollow cutter.

We claim:

1. A pour spout construction for a pour spout fitment for a dispensing carton for containing product, the pour spout fitment adapted to be affixed to the carton and aligned with a dispensing opening of the carton, said carton dispensing opening initially covered and spanned and sealed by a severable membrane, said fitment including a hollow rotatable cutter having at one end cutting teeth, each of said teeth having a base secured to said cutter, the bases of said teeth defining a single first plane, a plurality of filter bars carried by said cutter and diametrically spanning said pour spout to prevent said membrane, when severed, from passing through said pour spout or said cutter upon dispensing said product from said carton, said plurality of bars having spaces between them to define flow areas to permit dispensing product, said plurality of bars defining a single second plane, said first and second planes being substantially coincident.

2. The construction of claim 1 wherein said bars intersect each other.

3. The construction of claim 2 wherein said bars and said cutter are integrally molded together.

4. A pour spout construction for a pour spout fitment for a dispensing carton for containing product, the pour spout fitment adapted to be affixed to the carton and aligned with a dispensing opening of the carton, said carton dispensing opening initially covered and spanned and sealed by a severable membrane, said fitment including a hollow rotatable cutter having at one end cutting teeth, each of said teeth having a base secured to said cutter, the bases of said teeth defining a single first plane, a plurality of filter bars carried by said cutter and diametrically spanning said pour spout to prevent said membrane, when severed, from passing through said pour spout or said cutter upon dispensing said product from said carton, said plurality of bars having spaces between them to define flow areas to permit dispensing product, said plurality of bars defining a single second plane, said first and second planes being substantially coincident, an outer cap threaded on an outer portion of said pour spout fitment, said outer cap having at least one internal, downwardly vertically extending cap arm having a lowermost end portion, said cap arm slidably engaging an internal portion of said hollow rotatable cutter, said arm lowermost end portion terminating above said first and second planes.

* * * * *